US011255046B2

(12) United States Patent
Kesseli et al.

(10) Patent No.: US 11,255,046 B2
(45) Date of Patent: Feb. 22, 2022

(54) SCREEN ASSEMBLY FOR PULP DIGESTERS AND OTHER TREATMENT VESSELS IN PULP PRODUCTION

(71) Applicant: ANDRITZ OY, Helsinki (FI)

(72) Inventors: Henri Kesseli, Kotka (FI); Paavo Tolonen, Savonlinna (FI)

(73) Assignee: Andritz Oy, Helsinki (FI)

( * ) Notice: Subject to any disclaimer, the term of this patent is extended or adjusted under 35 U.S.C. 154(b) by 94 days.

(21) Appl. No.: 16/342,364

(22) PCT Filed: Oct. 16, 2017

(86) PCT No.: PCT/FI2017/050721

§ 371 (c)(1),
(2) Date: Apr. 16, 2019

(87) PCT Pub. No.: WO2018/073491

PCT Pub. Date: Apr. 26, 2018

(65) Prior Publication Data

US 2019/0242059 A1 Aug. 8, 2019

Related U.S. Application Data

(60) Provisional application No. 62/409,102, filed on Oct. 17, 2016.

(51) Int. Cl.

| | |
|---|---|
| ***D21C 7/08*** | (2006.01) |
| ***D21D 5/16*** | (2006.01) |
| ***D21C 7/00*** | (2006.01) |

(52) U.S. Cl.
CPC ..... *D21C 7/08* (2013.01); *D21C 7/00* (2013.01); *D21D 5/16* (2013.01)

(58) Field of Classification Search
CPC ..... D21D 5/02; D21D 5/023; D21D 5/04; D21D 5/046; D21D 5/16; D21C 7/00; D21C 7/04; D21C 7/08
(Continued)

(56) References Cited

U.S. PATENT DOCUMENTS

| | | | | |
|---|---|---|---|---|
| 28,062 A * | 5/1860 | Buchanan | ..... | D21C 7/00 162/251 |
| 2,163,437 A * | 6/1939 | Richmond | ..... | D21C 7/00 162/251 |

(Continued)

FOREIGN PATENT DOCUMENTS

| | | |
|---|---|---|
| DE | 28095 | 8/1884 |
| DE | 10 2011 005 224 | 9/2012 |

(Continued)

OTHER PUBLICATIONS

International Search Report for PCT/FI2017/050721, dated Jan. 26, 2018, 6 pages.

(Continued)

*Primary Examiner* — Eric Hug
(74) *Attorney, Agent, or Firm* — Nixon & Vanderhye P.C.

(57) ABSTRACT

A screen assembly for a digester, impregnation vessel or other treatment vessel for separation of cooking liquor or treatment liquor from lignocellulosic material, typically in a form of chips, in the production of chemical cellulose pulp, which screen assembly includes a plurality of screen panels (17) of woven wire mesh cloth and attachment device configured to attach the screen panels to a support frame of the digester or vessel.

18 Claims, 7 Drawing Sheets

(58) Field of Classification Search
USPC ..... 162/251
See application file for complete search history.

(56) References Cited

U.S. PATENT DOCUMENTS

| | | | | | |
|---|---|---|---|---|---|
| 2,765,645 | A * | 10/1956 | Hannunkari | D21C 9/04 | 68/181 R |
| 2,852,369 | A | 9/1958 | Eyolfson | | |
| 4,950,403 | A * | 8/1990 | Hauff | D21D 5/046 | 210/486 |
| 2006/0261001 | A1 * | 11/2006 | Hagg | D21F 1/66 | 210/486 |

FOREIGN PATENT DOCUMENTS

| | | | | |
|---|---|---|---|---|
| EP | 0 597 682 | | 5/1994 | |
| EP | 0597682 | * | 5/1994 | D21D 5/04 |

OTHER PUBLICATIONS

Written Opinion of the ISA for PCT/FI2017/050721, dated Jan. 26, 2018, 9 pages.

* cited by examiner

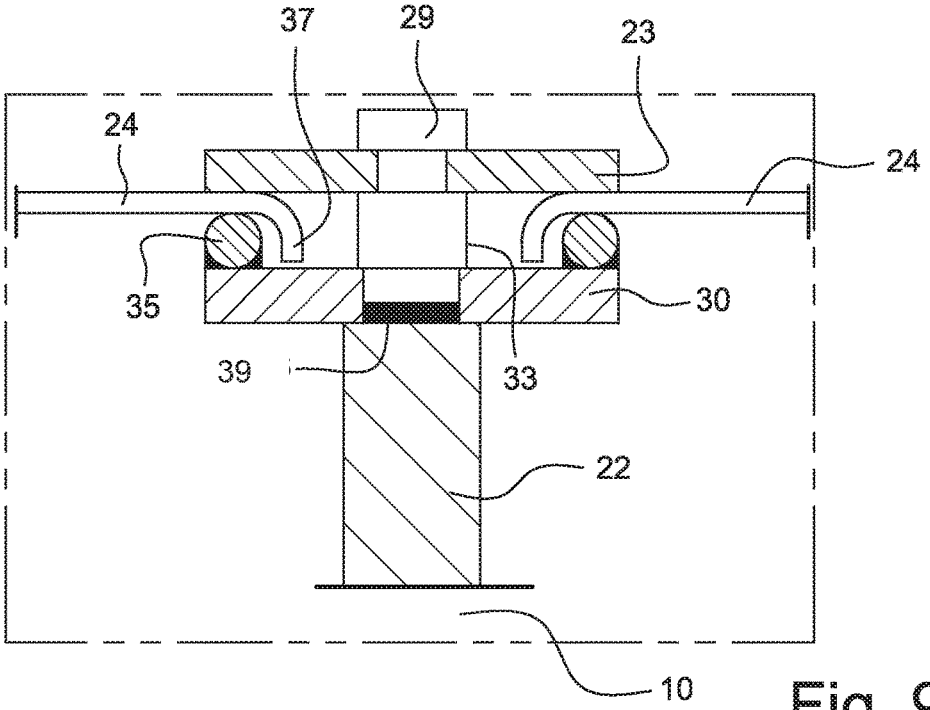
Fig. 9
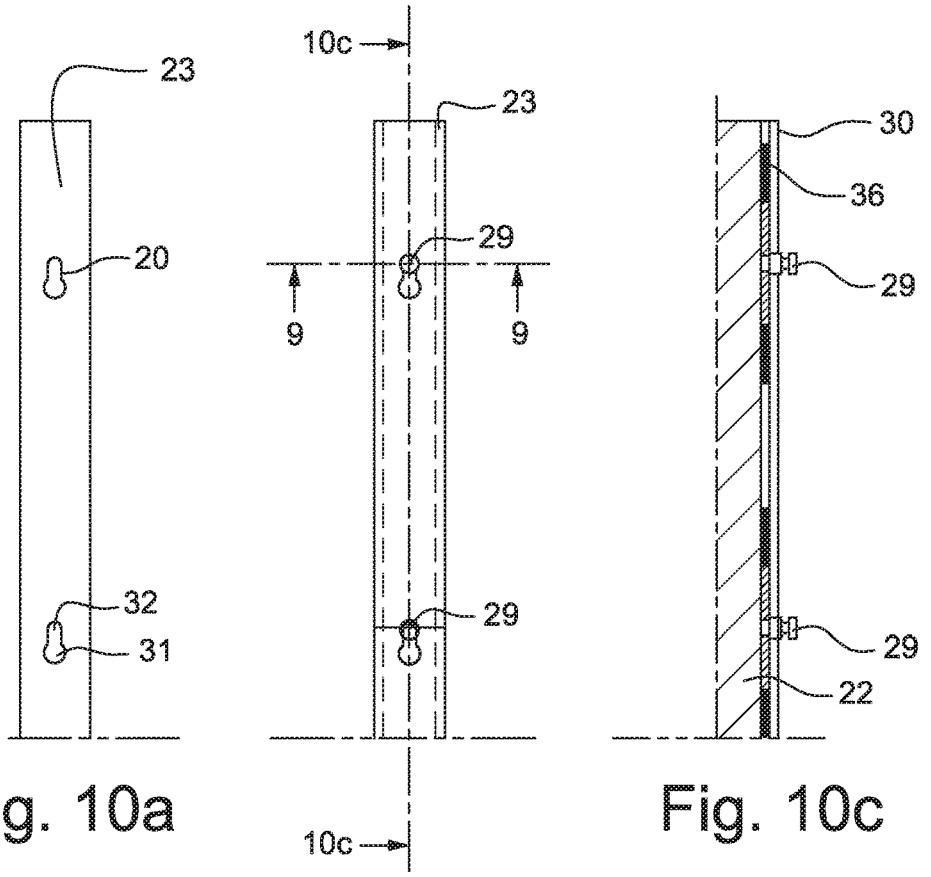
Fig. 10a
Fig. 10b
Fig. 10c

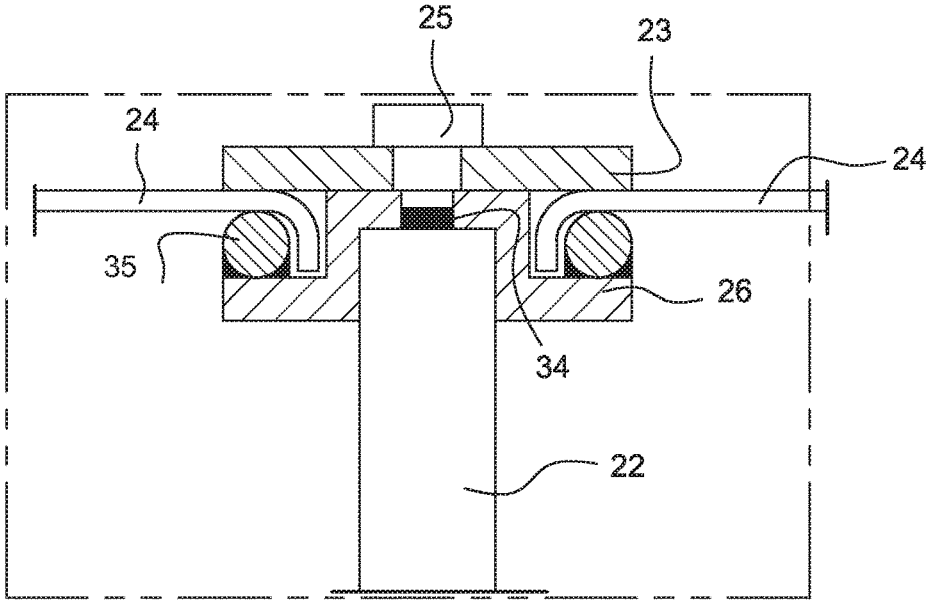
Fig. 11
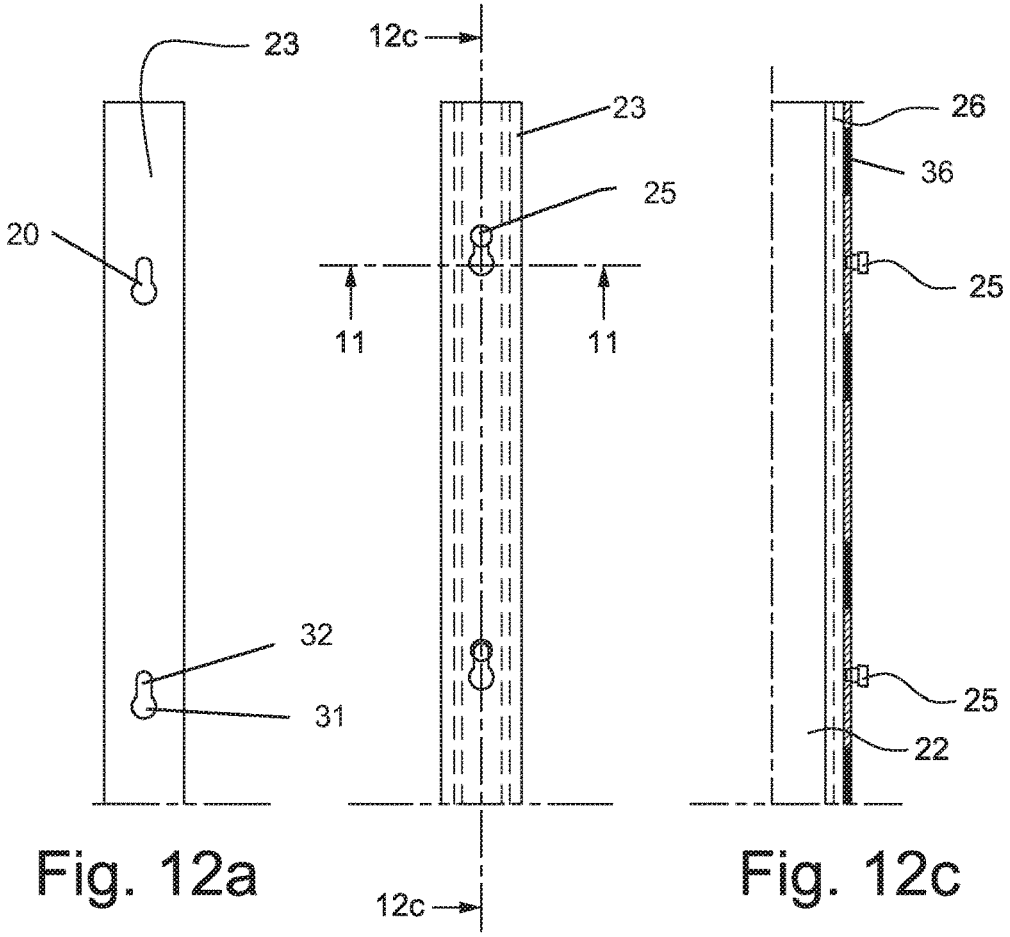
Fig. 12a
Fig. 12c
Fig. 12b

SCREEN ASSEMBLY FOR PULP DIGESTERS AND OTHER TREATMENT VESSELS IN PULP PRODUCTION

RELATED APPLICATIONS

This application is the U.S. national phase of International Application PCT/FI2017/050721 filed Oct. 16, 2017, which designated the U.S. and claims priority to U.S. Provisional Patent Application 62/409,102 filed Oct. 17, 2016, both of which applications are incorporated by reference in their entirety.

FIELD OF THE INVENTION

The present disclosure relates to a strainer/screen assembly for pulp digesters and impregnation vessels in the production of chemical cellulose pulp. Preferably the strainer/screen assembly may be utilized e.g. in a batch cooking process of the pulping industry for separating cooking liquor and comminuted lignocellulosic particles, typically in a form of chips. The present disclosure relates also to a treatment vessel.

The strainer/screen assembly according to the invention may be applied also in continuous digesters and impregnation vessels and other treatment vessels, where the strainers/screens are used for separation of liquor and comminuted cellulosic materials.

BACKGROUND OF THE INVENTION

Wood chips and other cellulosic fibrous material are treated in impregnation vessels and digesters to chemically separate fibers in the chips and material by, for example, removing lignin. A digester is a vessel in which comminuted cellulosic material, such as wood chips, are treated with heat, liquid, and chemicals to convert the chips to pulp. A continuous digester vessel is typically an upright cylinder with an upper inlet to receive chips in a continuous flow. The chips flow slowly through the digester vessel, 30 to 100 meters tall, in a generally downward direction.

As the chips move through the continuous digester, the lignins binding fibers together in the chips release the fibers and the chips are converted to pulp. The pulp is removed through a bottom outlet of the digester. Chips are continually added to a continuous digester while the chips already in the digester vessel are processed and pulp is discharged from the bottom of the vessel. In a batch digester, chips are first loaded in a vessel, the loaded chips are processed as a batch and thereafter the processed chips are discharged to empty the vessel. In a batch digester the chips tend to remain in substantially the same location in the vessel.

Chemicals, e.g., cooking liquor, in a digester process the chips, cause lignins to unbind fibers and convert the chips to pulp. The chemicals are included in cooking liquor that is continuously pumped into and out of batch and continuous digesters. Screens, such as screen plates, are used in conventional digesters for the production of chemical cellulose pulp, e.g. kraft pulp, for both continuous and batch digesters. Screens are filters that allow liquor to be extracted from a digester but prevent the extraction of fibrous material. Screen plates are generally arranged around an inner circumference of a digester. An inner surface of the screen, such as a plate, is exposed to the chip slurry in the digester and an outer surface of the screen forms a wall to a liquor extraction chamber. The screen may have multiple rows of narrow slots through which liquor (but not fiber) is extracted from the chip slurry and flows into the extraction chamber.

There are several types of screens used in said applications. The screen types commonly used are perforated screen plates with circular holes, stave screens, profile bar screens and slotted screen plates.

Typical problems with the existing screens are: (i) limited open area which restricts the flows through the screen openings; (ii) tendency to accumulate various types of scale deposits on the screen. The scaling, such as calcium carbonate precipitation, is due to chemical reactions of liquor and raw material. This increases the limitation of the screen open area; (iii) mechanical failures, especially in a batch cooking process where the pressure difference over the screen and even the direction of the pressure difference is cyclic. It causes fatigue stress for the screens which typically leads to fatigue failures. The conventional solution to this problem has been to make a more rigid screen construction so that the construction keeps its form under the load. This has resulted in heavy and massive screen constructions; (iv) chips are able to pass through the screen during chip column movement when the screen has long parallel slots, and (v) cleaning or replacement of the screens takes a long time and it is costly. This is caused by the heavy weight of the screens and their fastening methods.

There is a long felt need for screens of the digesters and impregnation vessels or pre-hydrolysis vessels, which have a reduced risk of being clogged or plugged by deposits or chips. The screens should also have a lighter construction, but a good resistance to fatigue stress.

SUMMARY OF THE INVENTION

A novel screen assembly for digesters and other treatment vessels, such as impregnation and pre-hydrolysis vessels or other treatment vessels, has been developed comprising a woven non-welded mesh screen. The novel screen assemblies disclosed herein are applicable to batch digesters and continuous digesters and impregnation vessels. Characteristics of a novel screen assembly and a novel treatment vessel become apparent in the appended claims.

The screen assembly comprises a plurality of screen panels of woven wire mesh cloth and attachment means or fasteners for the screen panels, which means typically comprise side clamps, upper end clamps, lower end clamps, fastening bolts or studs and fastening plates.

The screen is woven, non-welded wire mesh screen having openings. The wire is typically made of stainless steel. The cross-section of the wire is typically round, but it may have also another shape. The wire diameter is typically from 0.5 mm to 7 mm.

In the present screen assemblies suitable commercially available woven wire mesh cloths can be used. The openings may typically be square or rectangular. The opening has at least two sides. The length of the shortest side is 1-7 millimeters (mm), and the length of the longest side 1-50 mm, typically 10-50 mm. For instance, if the shape of the opening is rectangular, the width of the opening is typically 1 mm-7 mm and the length thereof is typically 10 mm-50 mm. The shape of the opening may also be quadratic, triangular or rhombus. Other opening shapes are also possible, if they are suitable for digester screens.

The wire mesh screen can have different types of weaves. Typical weaves are plain, dutch, twilled and twilled dutch. As known, in the plain weave each warp and each weft wire passes over one and under the next adjacent wire in both directions.

In the dutch weave pattern each warp and shoot wire passes alternately over and under each successive wire. In the twilled weave each weft wire passes successively over two and under two warp wires and vice versa. Other suitable weaves are such as double crimp, single intermediate crimp, double intermediate crimp and lock crimp. Other suitable weaves are also possible so that the shape of the opening is triangular or rhombus.

The edges of a wire mesh screen section for a screen panel may be straight, bent or folded. It is possible that all edges are not treated in the same way. Two opposite edges may be folded, but the other opposite edges may be straight. In addition, one or more of the edges may be reinforced.

The screen has to have a sufficient open area, which means the ratio of the free area between the wires to the total area of a given section of wire screen, expressed as a percentage. In the present invention the wire mesh screen has typically an open area of at least 45%, typically from 45% to 60%, even over 60%. When utilizing the type of woven, non-welded wire mesh screens according to the present invention the open area of the screen is significantly higher than in any existing digester/impregnator screen types (profile bar/stave, slotted plate, perforated plate, round bars or etc.). This is due to a unique structure of the screen compared to all prior art used in these applications. A greater open area of the screen allows higher liquor flow passing through the screen in same pressure difference.

The wire screen section for a screen panel can be made of one or several mesh screen layers. Two or more layers may be placed so that one mesh screen layer overlies another mesh screen layer.

A digester screen is typically formed by attaching screen panels to a support frame located in or on the digester shell. Each panel has an upper end clamp and a lower end clamp. The adjacent panels have common side clamps and fastening plates. The side clamps are fastened to the fastening plates by fastening bolts or studs or corresponding fastening means. The fastening plates are attached to the support frame. The side edges of the woven wire mesh screen section may be bent. The side edges can also be straight or folded doubly. The straight, bent or folded edges may be reinforced with metal or another suitable material.

The screen assembly is formed of a plurality of screen panels, which are attached by side clamps and bolts to each other and to the support frame as described above. Each screen assembly forms generally an annular ring or annulus around the inside wall of the cylindrical shell of the digester or other treatment vessel. The new screen arrangement can be easily attached to the screen support frame structure of an existing digester or another treatment vessel, when a previous screen is replaced with a new one.

The woven wire mesh screen is allowed to be flexible under changing pressure difference over the screen. It will not be broken, even though its form changes. The screen is attached to the support structure so that the screen can be flexible. This is typically done by side clamps, an upper end clamp, a lower end clamp, fastening bolts and fastening plates. The flexible construction of the wire mesh screen and the fastening system makes the screen self-cleaning against scaling and jammed chip particles. Once the pressure difference deforms the screen the deformation cleans the screen. The pressure difference will bend the screen wires which can break a hard scaling layer and even prevent building up of the scaling layer onto the wires. Aforesaid feature provides improved long lasting cleanliness for the screens and allows extended running period between outages. It also reduces maintenance requirement. Other suitable attachment means may also be used.

The new screen gives higher washing result, because the open area can be high and liquors can flow more efficiently.

The new screen assembly reduces the cleaning and replacement time of the screens. The wire mesh screen assembly makes maintenance and cleaning of the screens and their background faster and easier, thus saving needed downtime. This advantage is a result of non-welded, sliding screen fastening and the light weight of the screen panels.

The said assembly is resistant against mechanical and especially cyclic stress.

The invention relates also to a treatment vessel comprising:

an interior chamber;

an inlet and an outlet configured to receive comminuted cellulosic material and liquor and pass the cellulosic material and liquor into the and out of the chamber;

screen panels within the chamber and opposite to an inside surface of a wall of the chamber, the screen panels comprising woven wire mesh; and fasteners mounting the screen panels within the chamber.

The fasteners or attachment means for each panel typically include at least one of side clamps, an upper end clamp, a lower end clamp, fastening bolts or studs and a fastening plate.

The treatment vessel further comprises a frame between the screen panels and the wall and the fasteners mount the screen panels to the frame. The frame may include an elongated frame rib extending inward into the chamber from the wall, wherein an edge of a first screen panel of the screen panels is adjacent the elongated rib and an edge of a second screen panel of the screen panels is adjacent the elongated rib.

The fastener may include an elongated fastening plate which overlapped by both the edge of the first screen panel and the edge of the second screen panel. The fastener may further comprise an elongated side clamp which overlaps both the edge of the first screen panel and the edge of the second screen panel, and the edges of the first and second screen panels are sandwiched between the side clamp and the fastening plate.

The woven wire mesh may include a first array of wires arranged in parallel and a second array of wires arranged in parallel and orthogonal to the first array. The wires of the first array are interlaced with the wires of the second array. The wires of the first array may touch the wires of the second array where the wires of the first array cross the wires of the second array.

A distance between adjacent ones of the wires in the first array is typically in a range of 1 to 7 millimeters (mm), and a distance between adjacent ones of the wires in the second array is typically in a range of 1 to 50 mm. A distance between adjacent ones of the wires in the first array may be less than a distance between adjacent ones of the wires in the second array.

There is typically a need to replace screens in existing digesters and impregnation vessels and other treatment vessels. The new screen assembly is advantageous, because it can be attached to an existing support frame structure of the digester or other vessel.

BRIEF DESCRIPTION OF THE DRAWINGS

In the following the invention is described in more detail by reference to the accompanying drawings wherein.

FIGS. 9, 10*a*, 10*b*, 10*c*, 11 and 12*a*, 12*b* and 12*c* illustrate other fastenings of a mesh screen in strainers of a batch digester and a continuous digester and other treatment vessels.

DETAILED DESCRIPTION OF THE DRAWINGS

Figure 1:
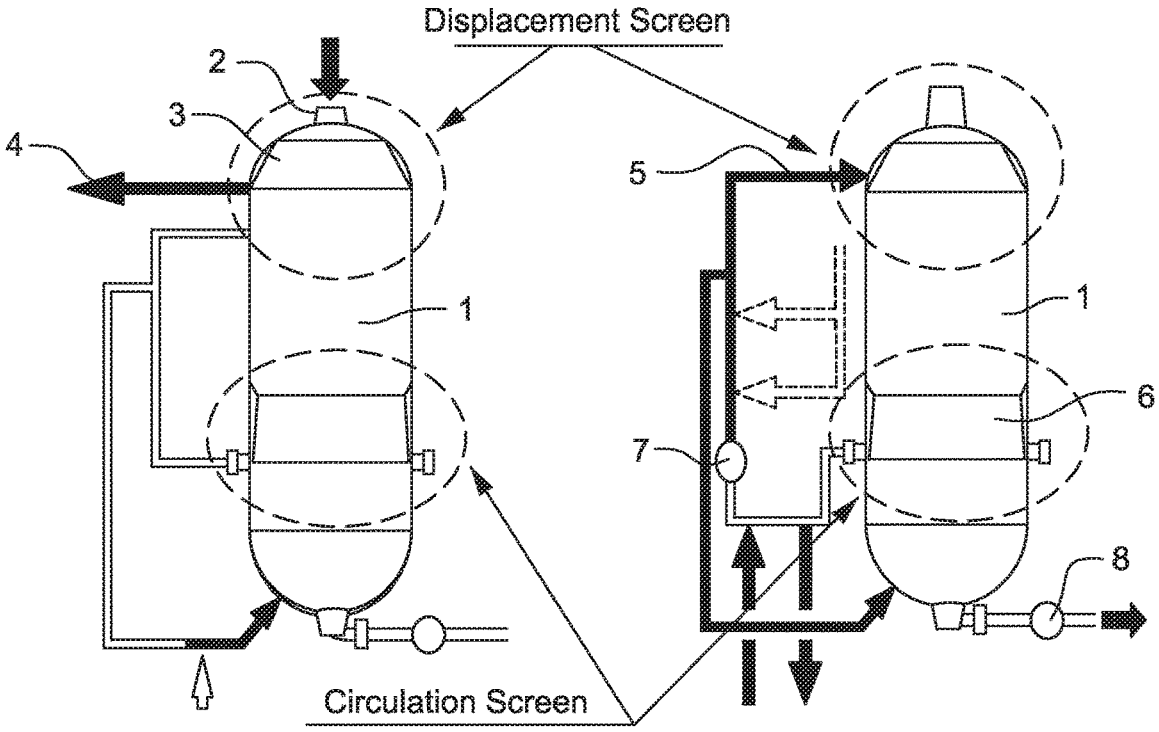
FIG. 1 illustrates a batch digester during liquor filling (left) and during liquor circulation (right) and typical process locations where the new screen assembly may be applied.

FIG. 1 illustrates a batch digester 1 for cooking during liquor filling (left) and during liquor circulation (right). A typical displacement batch cooking starts with the digester being filled with cellulosic material, such as chips, through an inlet 2. The filling of the digester is followed by impregnation and hot displacement of the cellulosic material in the digester. Liquors are discharged from the digester through displacement screens 3 to line 4. Liquors can also be discharged through circulation screens during any liquor filling of the digester. After the digester is filled with cellulosic material and liquor, the material in the batch digester is heated to the cooking temperature, typically 130-180° C., and the cooking process is performed. Liquor is pulled through circulation screens 6 and is circulated during the heating and cooking stage. The cooking process is ended with a cold displacement and the pulp is discharged from the digester by pump 8. The screens according to the present invention can be used as circulation screens 3 and displacement screens 6 in batch digesters.

Figure 2:
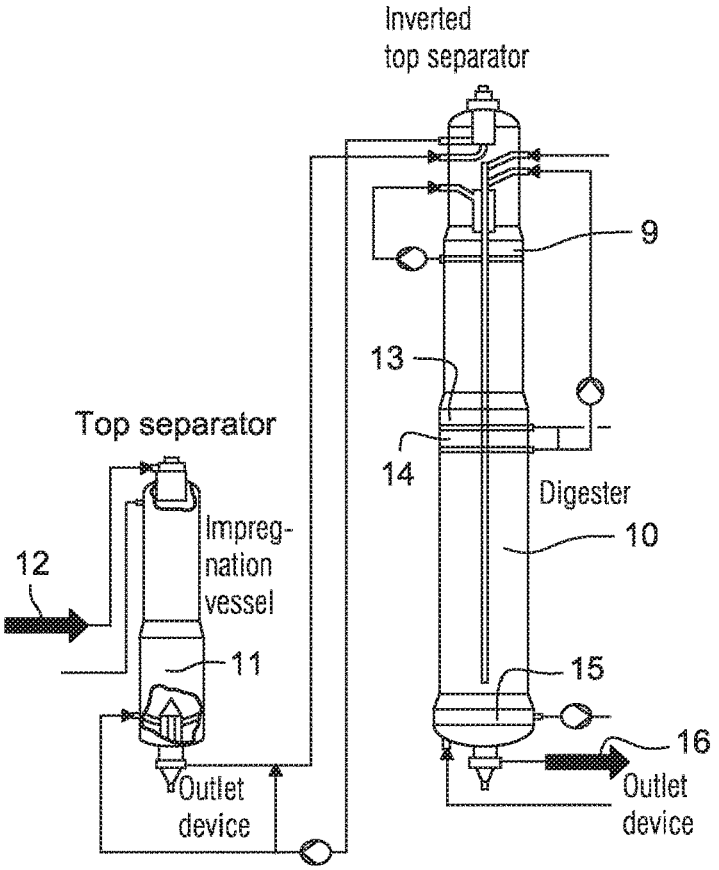
FIG. 2 illustrates typical process locations in a continuous digester, where the new screen assembly may be applied.

FIG. 2 is a side view of an impregnation vessel 11 and a continuous vertical pressurized digester 10 for processing cellulosic fiberous material, e.g., wood chips, into fiber pulp. A slurry of comminuted cellulosic fibrous material and cooking chemical is introduced through line 12 at the top of the impregnation vessel. The impregnated material is discharged at the bottom of the impregnation vessel and introduced to the top of the digester. The material is cooked in the pressurized digester typically at a temperature of 130-180° C. The slurry of fully-cooked pulp and spent cooking liquor is discharged at the bottom and fed to line 16. The digester 10 comprises a cylindrical shell that typically forms a column of, for example, 100 feet (30 meters) tall. Within the cylindrical shell are several cylindrical screen assemblies 9, 13, 14 and 15. In continuous digesters said screens are typically cooking screens 9, extraction screens 13, 14 and washing screens 15, as shown in FIG. 2. Some systems have a pressurized or non-pressurized impregnation vessel 11 which may have screens for liquor separation.

Figure 8:
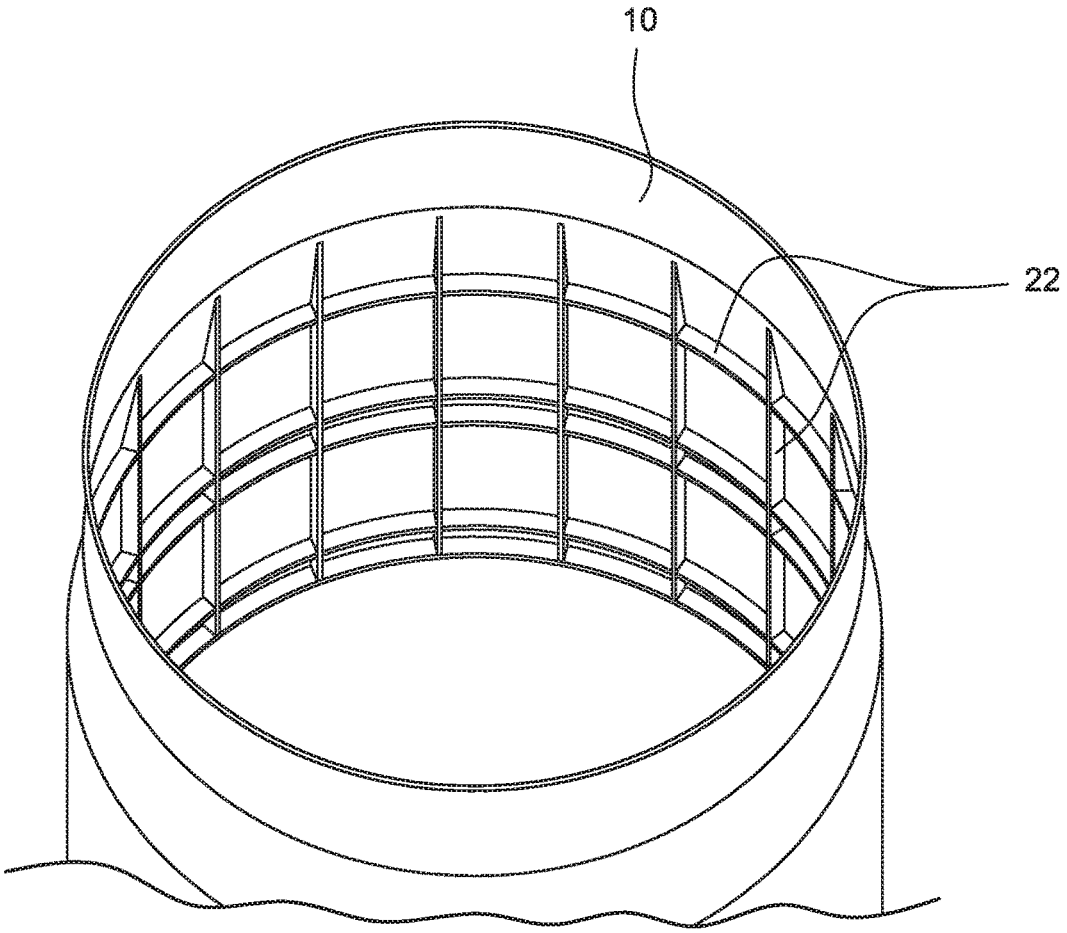
FIG. 8 illustrates a screen support frame in a continuous digester.

Known screens may include screen plates assembled to form a cylindrical screen, such as screens 13 and 14. The screen plates are attached to a frame 22 on the inner wall of the digester shell, as shown in FIG. 8. The frame 22, for example, comprises metal bars, angle irons, or corresponding structural elements which are connected directly to the digester shell, although the frame 22 may be distinct and detachable from the digester. Each screen forms generally an annular ring around the inside wall of the cylindrical shell of the digester 10.

Figure 3:
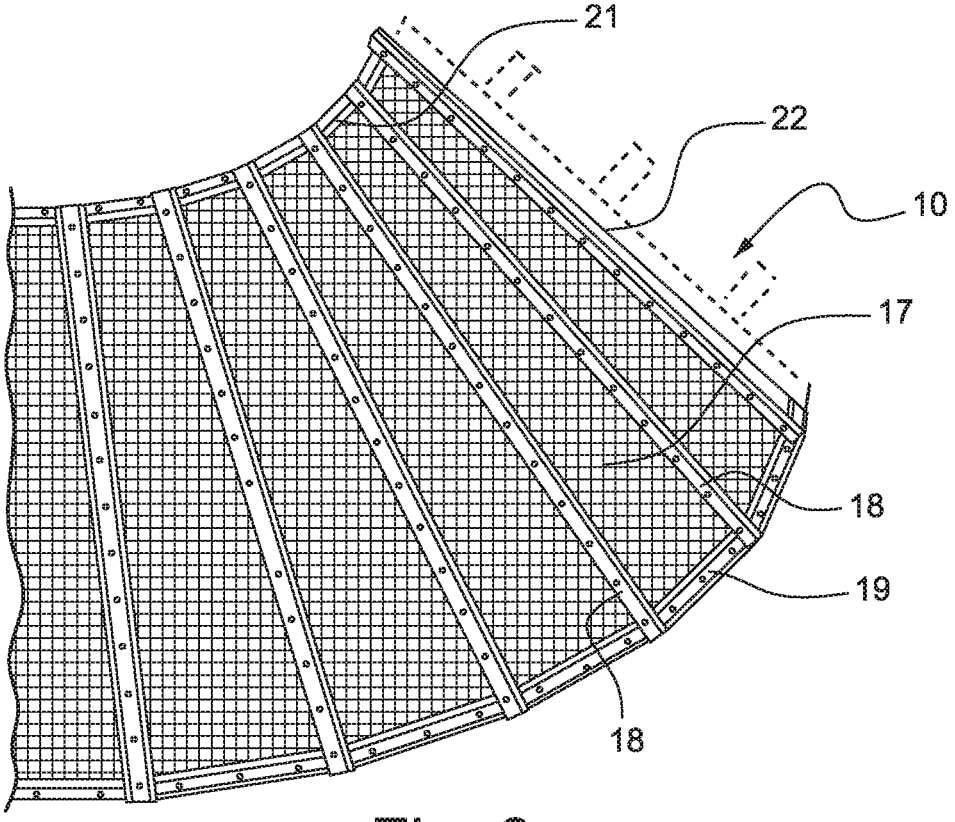
FIGS. 3 and 4 illustrate an attachment of an embodiment of the mesh screen in a batch digester displacement strainer.
Figure 4:
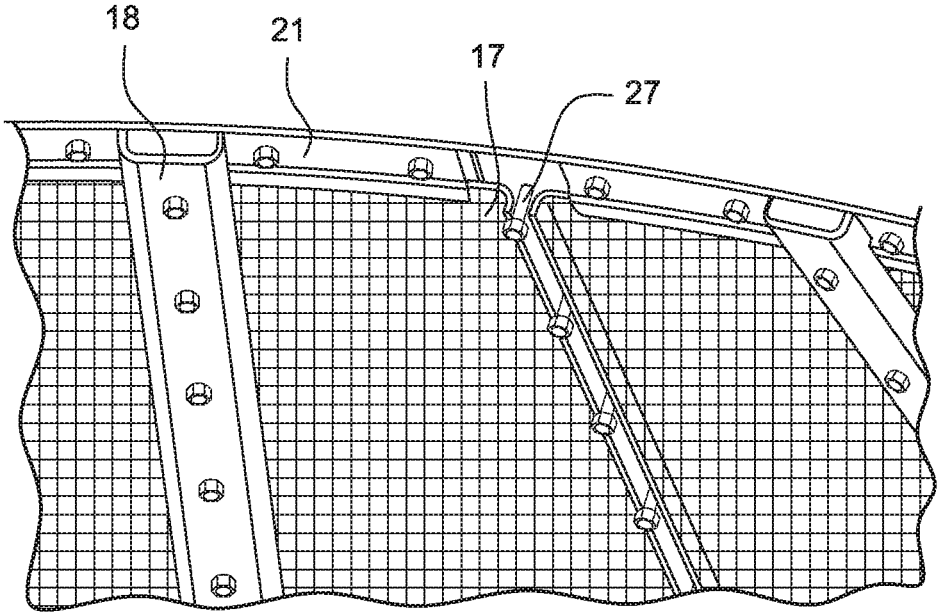
Figure 5:
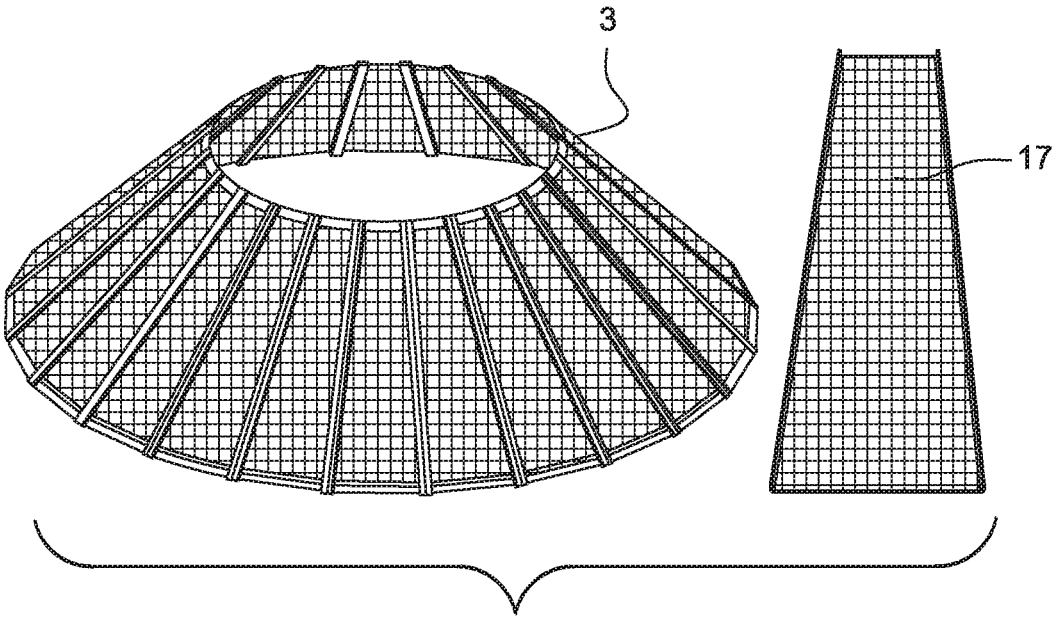
FIG. 5 illustrates an installation of a mesh screen assembly and a mesh screen panel for a batch digester displacement strainer.
Figure 6:
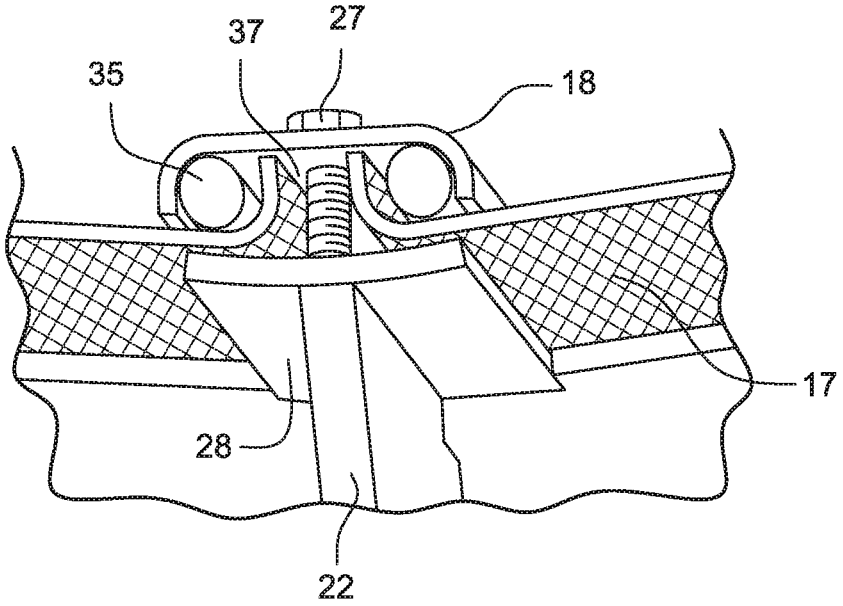
FIG. 6 illustrates a fastening of a mesh screen in a batch digester displacement strainer.

FIGS. 3 to 6 illustrate a screen assembly according to the present invention which is used as a batch digester displacement screen or strainer. The location of the displacement screen is described in connection with FIG. 1 above. The assembly comprises a plurality of screen panels 17 of a woven non-welded wire mesh. A fastening system of the woven wire mesh panels comprises side clamps 18, an upper end clamp 21, a lower end clamp 19, fastening bolts 27 and fastening plates 28. FIG. 3 shows also a support frame 22 for the screen assembly. The frame 22 is located on the inner wall of the digester 10. The side clamps 18 and the end clamps 19, 21 are attached to the fastening plates with the bolts 27, as shown in FIG. 4. FIG. 6 shows a detail view of the fastening system for screen panels. The fastening plate 28 is attached by welding to the bars or ribs of the support frame 22. The adjacent screen panels 17 are disposed between the fastening plate 28 and the side clamp 18. The side clamp 18 is attached to the fastening plate with fastening bolts 27 or studs. The fastening bolt 27 is attached to the fastening plate by welding. Alternatively, the fastening plate may have a threaded bore for receiving a fastening bolt. The side edges of the woven wire mesh screen section are bent, as shown in FIG. 6. The bent side edges of two adjacent screen sections are placed between the side clamp 18 and the fastening plate 28, which are attached with bolts. The side edges can also be straight or folded doubly. The straight, bent or folded edges may be reinforced.

FIG. 5 shows a complete screen assembly 3 according to the present invention. The screen is formed of a plurality of woven non-welded wire mesh screen panels 17. A single screen panel 17 is also shown in FIG. 5. The conical screen assembly is typically used as a displacement strainer in the upper part of a batch digester.

Figure 7:
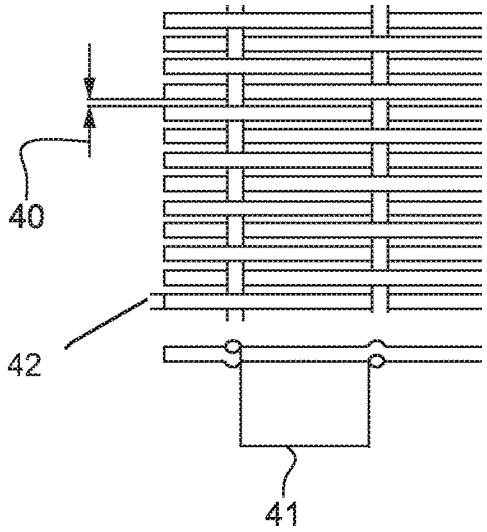
FIG. 7 illustrates a woven non-welded wire mesh.

FIG. 7 shows a woven non-welded wire mesh, which can preferably be used in the new screen assembly. The screen can have different types of weaves. In FIG. 7 the screen has a plain weave. The screen has rectangular apertures, which have a width 40 of 1 mm-7 mm and a length 41 of 1-50 mm, typically 10 mm-50 mm. The diameter of the screen wires 42 is from 0.5 mm to 7 mm.

FIG. 8 illustrates a screen support frame 22 which is located on the inner wall of the digester shell 10. The frame 22 comprises metal bars, angle irons, or corresponding structural elements.

FIGS. 9 and 10*a*, 10*b* and 10*c* illustrate a fastening system for screen panels. This can be used in batch digesters and in continuous digesters and in other treatment vessels in a digester plant of a pulp mill. FIG. 10*a* shows a side clamp 23. The side clamp is formed of an elongated plate 23. There are key hole type slots 20 in the side clamp which slots have an enlarged portion 31 and a narrow portion 32. FIG. 10*b* shows a front view of the fastening system comprising the side clamp 23. FIG. 10*c* depicts a cross-sectional view of the fastening system taken along lines 10*c*-10*c* of FIG. 10*b*. FIG. 9 shows a detailed cross-sectional view of the fastening system taken along lines 9-9 in FIG. 10*b*. In FIG. 9 a straight fastening plate 30 is attached by welding to the support frame 22. FIG. 10*c* illustrates welds (solid black zones 36) which attach the fastening plate 30 to the frame 22. The fastening plate is provided with an opening 39 for a fastening bolt 29, which is also welded to the frame 22. The bent side edges of screen panels 24 are placed against the fastening plate. Sealing rods 35 may be welded to the front face of the fastening plate 30 and along the length of the fastening plate. The sealing rods form a surface against on which seats an edge region of the screen panel. A curved lip 37 at the edge region of the screen panel curves around the sealing rod and hooks the screen panel to the fastening plate. The screen panels are pressed against the fastening plate by means of the side clamp 23. The edge region of the screen panels are sandwiched between the sealing rods and the side clamp.

Each fastening bolt comprises a head portion, a narrow neck portion and a lower portion (shank). The diameter of the neck portion is smaller than that of the head or the lower portion. In order to install the side clamp the head portion of the bolt is inserted through the enlarged portion 31 of the keyhole slot. Then the side clamp is slid downwards on the neck portion of the bolt so that the neck of the bolt enters the narrow portion 32 of the slots, as shown in FIG. 10*b*. This means that the side clamp and thus also the screen panels are rigidly affixed.

There is a gap 33 between the fastening plate 30 and the side clamp 23, in which gap the side edges of the screen panels are located. This embodiment is advantageous especially when a new screen is installed to an existing frame of a digester. The empty gap provides more space for the installation action.

FIGS. 11 and 12*a*, 12*b* and 12*c* illustrate another fastening system for screen panels. This can be used also in batch digesters and in continuous digesters and in other treatment vessels in a digester plant of a pulp mill. Especially this embodiment is suitable to a circulation screen assembly of a batch digester. FIG. 12*a* shows a side clamp 23. The side clamp is formed of an elongated plate 23. As described in connection of FIGS. 9 and 10*a*, 10*b* and 10*c*, there are key hole type slots 20 in the side clamp. FIG. 12*b* shows a front view of the fastening system comprising the side clamp 23. FIG. 10*c* depicts a cross-sectional view of the fastening system taken along lines 12*c*-12*c* of FIG. 12*b*. FIG. 11 shows a detailed cross-sectional view of the fastening system taken along lines 11-11 in FIG. 12*b*. In FIG. 11 fastening plate 26 is bent against the support frame 22 and attached by welding to the frame 22. FIG. 12*c* illustrates welds (black zones 36) which attach the fastening plate 26 to the frame 22. The fastening plate is provided with an opening 34 for a fastening bolt 25, which is also welded to the frame 22. The bent side edges of screen panels 24 are placed against the fastening plate and the panels are pressed against the fastening plate by means of the side clamp 23. Each fastening bolt 25 comprises a head portion, a narrow neck portion and a lower portion (shank). The diameter of the neck portion is smaller than that of the head or the lower portion. In order to install the side clamp the head portion of the bolt is inserted through the enlarged portion 31 of the keyhole slot 20. Then the side clamp is slid downwards on the neck portion of the bolt so that the neck of the bolt enters the narrow portion 32 of the slots, as shown in FIG. 12*b*. This means that the side clamp and thus also the screen panels are rigidly affixed.

Figure 13:
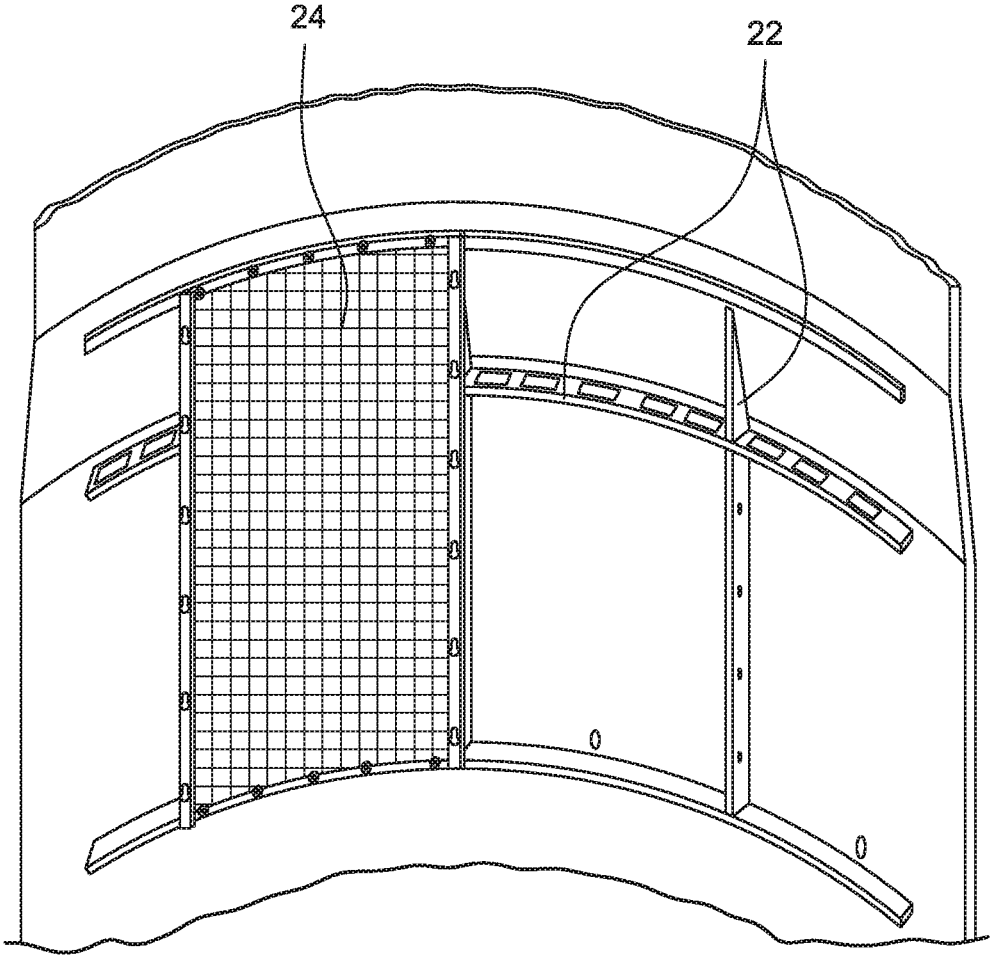
FIG. 13 illustrates a mesh screen panel as installed in a continuous digester.

FIG. 13 shows a part of the inner wall of a continuous digester and a part of a support frame 22 attached to the inner wall. A wire mesh screen panel 24 is connected to the frame, as described in connection with FIGS. 9-12.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A screen assembly for a digester, impregnation vessel or other treatment vessel for separation of cooking liquor or treatment liquor from lignocellulosic material in the production of chemical cellulose pulp, wherein the screen assembly comprises:

a plurality of screen panels, wherein each of the screen panels include a screen formed of woven, non-welded wire mesh cloth, and the plurality of screen panels are configured to allow passage of the cooking liquor or the treatment liquor and retain the lignocellulosic material, and an attachment device configured to attach the plurality of screen panels to a support frame, wherein the attachment device includes side clamps, an upper end clamp, a lower end clamp, fastening bolts or studs and a fastening plate for each of the screen panels.

2. The screen assembly according to claim 1, wherein the screen in each of the screen panels has openings, wherein a width of each of the openings is in a range of 1 mm to 7 mm and a length of each of the openings is in a range of 1 mm to 50 mm.

3. The screen assembly according to claim 1, wherein the screen of each of the screen panels has openings, each of the openings are a square or rectangular opening, and which each of the openings have a width of 1 mm-7 mm and a length of 1 to 50 mm.

4. The screen assembly according to claim 1, wherein the woven, non-welded wire mesh cloth is formed of screen wire that is round in cross section.

5. The screen assembly according to claim 4, wherein the woven, non-welded wire mesh cloth includes a screen wire having a diameter in a range of 0.5 mm to 7 mm.

6. The screen assembly according to claim 1, wherein the screen for each of the screen panels has rectangular, quadratic, triangular or rhombus apertures.

7. The screen assembly according to claim 1, wherein each of the screen panels has straight, bent or folded edges.

8. The screen assembly according to claim 7, wherein the edges of the screen panels are reinforced with metal or another material.

9. The screen assembly according to claim 1, wherein said woven wire, non-welded mesh cloth includes a weave of at least one of:

a plain weave, a double crimp weave, a single intermediate crimp weave, a double intermediate crimp weave, a lock crimp weave, a twill weave, a dutch weave, a dutch twill weave, a reverse dutch weave, and a reverse dutch twill weave.

10. The screen assembly according to claim 1, wherein the screen in each of the screen panels has a surface area that is at least 45% open.

11. The screen assembly according to claim 1, wherein the woven, non-welded wire mesh cloth includes a plurality of layers of woven wire, non-welded mesh cloth.

12. The screen assembly according to claim 1, wherein each of the screen panels is flexible.

13. The screen assembly according to claim 1, wherein the support frame includes a screen support frame structure of the digester, the impregnation vessel or the other treatment vessel.

14. The screen assembly of claim 1, wherein the woven wire, non-welded mesh cloth screen of each of the screen panels has a first side edge, and a second side edge, opposite to the first side edge, wherein the fastening plate is a first fastening plate aligned with and secured to the first side edge, and the screen assembly further comprises a second fastening plate aligned with and secured to the second side edge.

15. The screen assembly of claim 1, wherein each of the screen panels includes a first curved lip at the first side edge, and a second curved lip at the second side edge, and the screen assembly further comprises:

a first clamp;

a first sealing rod attached to the first fastening plate, wherein the first curved lip is clamped between the first clamp and the first sealing rod, a second clamp;

a second sealing rod attached to the second fastening plate, wherein the second curved lip is clamped between the second clamp and the second sealing rod.

16. The screen assembly of claim 14, wherein each of the screen panels includes a first curved lip at the first side edge, and a second curved lip at the second side edge, and the screen assembly further comprises:

a first clamp;

a first sealing rod attached to the first fastening plate, wherein the first curved lip is clamped between the first clamp and the first sealing rod, a second clamp;

a second sealing rod attached to the second fastening plate, wherein the second curved lip is clamped between the second clamp and the second sealing rod.

17. A screen assembly for a digester, an impregnation vessel or another treatment vessel, wherein the screen assembly is configured to separate cooking liquor or treatment liquor from lignocellulosic material, in the production of chemical cellulose pulp, wherein the screen assembly comprises:

screen panels each including a woven wire, non-welded mesh cloth screen, and an attachment assembly configured to attach the screen panels to a support frame of the digester, impregnation vessel or the other support vessel, wherein the attachment assembly includes side clamps, an upper end clamp, a lower end clamp, fastening bolts or studs, and a fastening plate for each of the screen panels.

18. The screen assembly of claim 17, wherein the woven wire, non-welded mesh cloth screen of each of the screen panels has a first side edge, and a second side edge, opposite to the first side edge, wherein the fastening plate is a first fastening plate aligned with and secured to the first side edge, and the screen assembly further comprises a second fastening plate aligned with and secured to the second side edge.

* * * * *